US005104344A

United States Patent [19]

Jancso, Jr.

[11] Patent Number: 5,104,344

[45] Date of Patent: Apr. 14, 1992

[54] LINE CONTROLLED ELECTRICALLY POWERED TOY AIRCRAFT

[76] Inventor: Andre Jancso, Jr., 7742 Redlands, D1043, Playa del Rey, Calif. 90293

[21] Appl. No.: 223,629

[22] Filed: Jul. 25, 1988

[51] Int. Cl.[5] ..... A63H 27/04

[52] U.S. Cl. ..... 446/31; 446/30; 446/32

[58] Field of Search ..... 446/30, 31, 32, 33; 272/31 R, 31 A

[56] References Cited

U.S. PATENT DOCUMENTS

| | | | |
|---|---|---|---|
| 2,611,351 | 9/1952 | Horner | 446/31 X |
| 3,161,988 | 12/1964 | Junker | 446/31 |
| 3,375,605 | 4/1968 | Gallagher | 446/31 |
| 3,579,905 | 5/1971 | Radford | 446/32 |
| 4,246,724 | 1/1981 | Vechot | 446/32 |

*Primary Examiner*—Robert A. Hafer
*Assistant Examiner*—Sam Rimell
*Attorney, Agent, or Firm*—Natan Epstein

[57] ABSTRACT

A toy aircraft electrically powered through control lines attached to a control handle held by a ground controller is improved by provision of a break resistant connection of electrical transmission wires which also function as elevator control cables to a bellcrank arrangement on the airframe, by use of knife disconnect connectors for mechanically and electrically interconnecting the handle, the control wires and the airframe, by use of fatigue resistant flexible steel cable segment coupling the handle to the control wires, and scrape protecting skid elements on the wing for also holding the lines wrapped on the wing for storage.

20 Claims, 4 Drawing Sheets

LINE CONTROLLED ELECTRICALLY POWERED TOY AIRCRAFT

BACKGROUND OF THE INVENTION

1. Field of the Invention

The present invention pertains to the field of flying toy aircraft and more particularly is directed to improvements in captive, line controlled electrically powered aircraft of the type which are supplied with electric power through the flight control lines.

2. State of the Prior Art

Electrically powered model aircraft were known at least as early as 1921 as evidenced by U.S. Pat. No. 1,364,203 issued to Modlin, which shows a model aircraft suspended from an electric fixture and provided with an electric motor supplied with electric power through the supporting wires. As electric motors evolved into smaller and more efficient units, it became possible to construct model aircraft capable of generating sufficient lift for true aerodynamic flight provided that power was supplied from a ground-based power source, such as a battery. Examples of such toy aircraft are disclosed in U.S. Pat. No. 2,439,054 issued to Mosthof and U.S. Pat. No. 3,579,905 issued to Radford et al. Further technological progress has made possible model aircraft capable of carrying their own power supply in the form of a rechargeable electric storage cell of capacity sufficient to power the aircraft during relatively brief flights. These aircraft require frequent recharging of the internal battery, usually after each flight and generally have not proven to be very popular.

Line controlled aircraft powered by gasoline engines have been long known as exemplified by U.S. Pat. No. 2,292,416 to Walker issued in 1941, and later U.S. Pat. Nos. 2,743,068 to Walker and 3,110,126 to Kretzmer, Jr. Gasoline powered captive flight aircraft have proven popular, particularly with novice hobbyists, but require the cooperation of two individuals for launching into the air; the "pilot" i.e. person who is to control the aircraft, must stand away from the aircraft with the control lines more or less taut, while an assistant starts the engine and holds back the aircraft until given the signal to let it roll towards take off. The small engines typically used do not have self-starters and the propellers must be manually turned to start the engine. Furthermore, once started, no means are usually provided for stopping the engine before it runs out of fuel. Therefore, once the aircraft has taken off, the operator is committed to a flight lasting for as long as the fuel supply allows. The small gasoline engines are quite noisy since typically no mufflers are provided, and are messy to work with because of inevitable spillage of fuel and lubricant fluids. Moreover, unless handled carefully, these engines are capable of inflicting serious bodily injury, particularly during engine start up when the propeller must be manually turned over until the engine fires, which frequently occurs in an unpredictable manner.

Both the Mosthof and Radford et al., patents teach the idea of supplying electric power to the model aircraft through the same pair of wires used to control an aerodynamic control surface, namely the tail elevator of the aircraft. In Mosthof, the two control/power wires run directly to the elevator through curved guide conduits in the fuselage, and a pair of slack wires are connected between a point along the control wires and the electric motor for supplying power to the latter. In flight, the wires connected to the elevator are held taut by centrifugal force as the aircraft flies in circles about the operator on the ground who is then able to adjust the flight attitude of the aircraft by pulling alternately on one or the other control wire to thereby raise or lower the elevator surface. Radford et al., improves over the Mosthof system by providing a bell crank pivotably mounted to the air frame. The control wires are connected to opposite ends of the bellcrank crossarm while a short arm on the bell crank is mechanically connected through a control rod to the hinged elevator. Slack conductive wires in turn are connected for carrying electric current from the control line ends on the cross arm to the propeller motor.

A continuing source of difficulty encountered in arrangements such as in Radford and also in Mosthof, is the susceptibility of the current carrying control lines to break under the strain of continuous centrifugal force and repeated flexing, particularly at the connections to the aircraft and the control handle. A direct mechanical or welded joint between the conductor wire and the bell crank as in Radford has been found to break after a relatively short flying time because of the aforementioned simultaneous centrifugal loading and flexing strain. The same problem occurs at the connection with the control handle held by the operator on the ground. As the aircraft circles the operator, the control handle tends to either lead or lag the aircraft in its circular path consequently subjecting the wires to repeated flexing at the ground end as well.

A continuing need therefore exists for improvement in model aircraft of the Radford type, particularly a need for dependable mechanical and electrical connections throughout the system capable of performing reliably under repeated mechanical flexing and loading.

SUMMARY OF THE INVENTION

This invention addresses the aforementioned needs and shortcomings in the prior art by providing a modular toy aircraft system which includes a toy aircraft having one or more electric motors mounted to an airframe, an electrically conductive pair of wires including slack portions connected from the motor or motors to opposite ends of the crossarm of a bellcrank pivotably mounted to the airframe, the wires further including straight portions extending from the cross-arm for connection to a control handle through a control line pair for transmitting controlling force from a ground operator to the bellcrank and connected at the control handle to a power supply for powering the motor or motors. A first improvement according to the novel toy system is the provision of roller means at each end of the cross arm, each conductive wire being tied into a loop between its straight and slack portions, such that the loop is easily rotatable on the corresponding roller relative to the cross-arm for transmitting mechanical force to the cross arm without flexing of the wires to minimize the likelihood of breakage due to mechanical fatigue during flight of the aircraft. The wires are preferably covered with insulating material and the rollers are of material such as Teflon (R) selected to make low friction contact with the insulating material.

A second improvement according to this invention is the provision of knife-disconnect type electrical connectors at both ends of the long wires of the control line pair to allow quick and easy separation of the handle and aircraft from the same, thus allowing ready interchange of these three elements (aircraft/control line pair/control handle) for example where the same handle may be connected to longer control wires for flying the same or another, larger aircraft requiring such longer lines. Specifically, the straight portions of the wires connected to the bellcrank terminate in knife disconnects to allow interchangeable connection with control wire pairs likewise terminating in knife disconnects.

A third improvement according to this invention is an improved control handle for transmitting controlling force from a ground operator to the bellcrank on the airframe. The handle has a hollow housing such as a length of tubing and two short lengths of stranded steel cable insulated from each other are each fixed at one end to the handle housing and provided with a knife-disconnect-type electrical connector at an opposite free end for connection to a corresponding one of the control line pair wires. The steel cable lengths are capable of better withstanding the repeated flexing which occurs at the juncture of the steel cables and the handle housing as the handle leads or lags movement of the circling aircraft. The pair of electrically conductive control lines terminate at both ends in a knife-disconnect-type electrical connector for operatively interconnecting the control handle with the toy aircraft.

A rechargeable battery pack which may be contained in the handle supplies electrical power to the system. The handle may have a first battery connector mateable to the connector of a standard external rechargeable battery. In a further improvement this modular system includes one or more multi-battery adapter modules, each module comprising a second connector mateable to a first connector on the handle and a two or more third connectors of gender opposite to that of the second connector. The third connectors are electrically in series with the second connector by means of short lengths of conductive wire to form a closed ring structure, whereby the voltages of batteries connected to each of the third connectors are summed at the second connector.

A still further novel improvement of this modular system is the provision of a wrap element removeably attacheable to each wingtip of the airframe for protecting the wingtip against contact with the ground during low level flight including take-off and landing, the skid elements being configured and arranged for providing a relatively large radius wrap surface to prevent kinking of the long control line pair wires when these wires are wrapped from wing-tip to wing-tip for convenience in carrying and storing the aircraft.

These and other advantages and novel features of this invention will be better understood from the detailed description below and accompanying drawings.

DETAILED DESCRIPTION OF THE PREFERRED EMBODIMENTS

Figure 1:
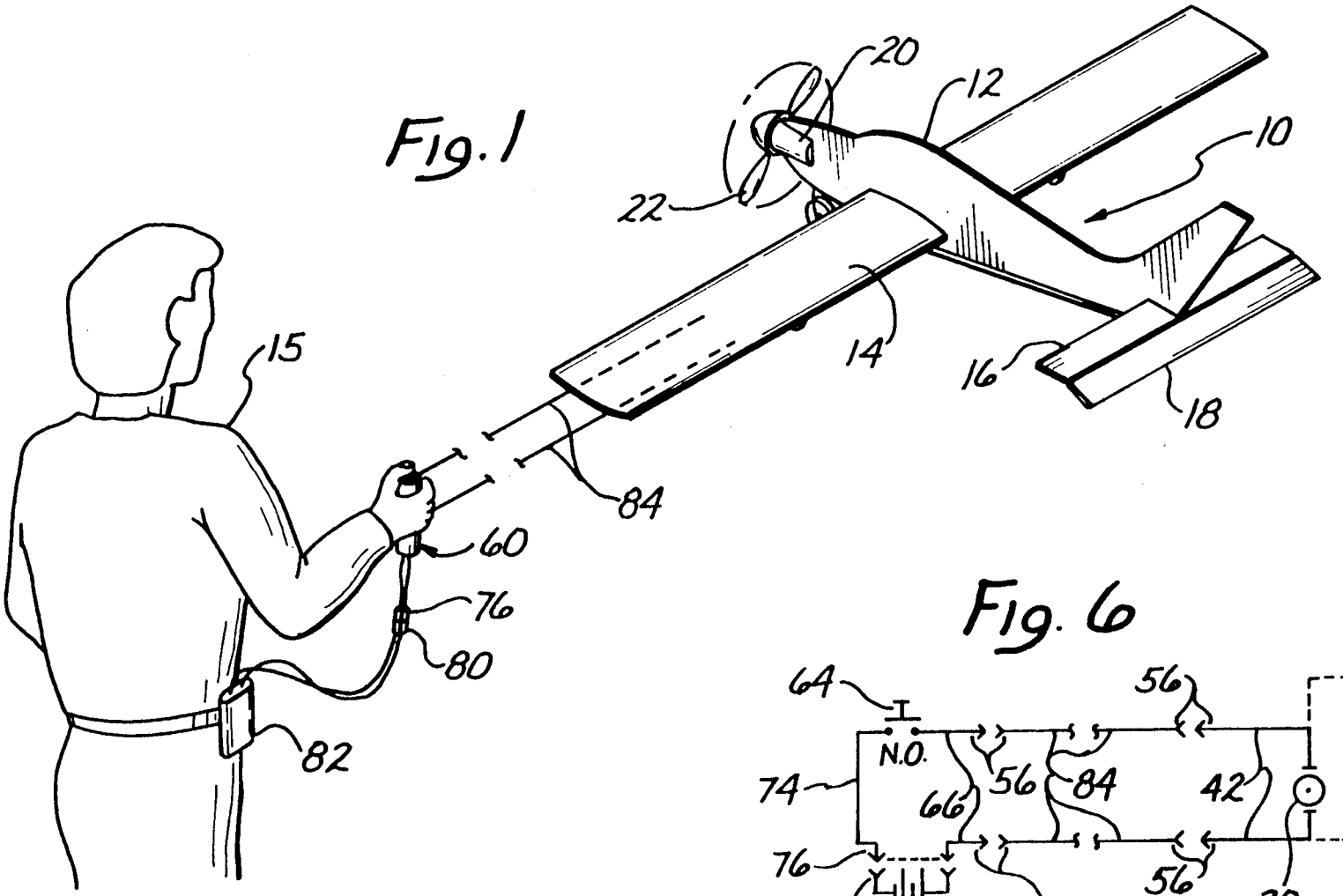
FIG. 1 shows a typical model aircraft improved according to this invention in captive flight.

With reference to the drawings, FIG. 1 shows a typical toy aircraft improved according to this invention being flown by a ground operator 15 at the end of a pair of relatively long control lines 84 connected to a control handle 60 held by the operator. The aircraft 10 describes a circular flight path centered on the ground operator who can make the aircraft climb and dip, land or take off and even perform aerobatic maneuvers such as loops, etc by appropriately manipulating the control lines by means of the handle 60. The aircraft includes an airframe 10 comprised in the present example of a silhouette style fuselage 12, a wing 14 and a tail stabilizer 16 which includes elevator 18 hinged to the stabilizer and movable up or down for adjusting the flight attitude of the aircraft in a manner which is well known. A fractional horsepower electric motor 20 is mounted to the nose of the fuselage 12 and turns a propeller 22 for providing thrust to the airframe causing the wing 14 to provide lift.

Figure 2:
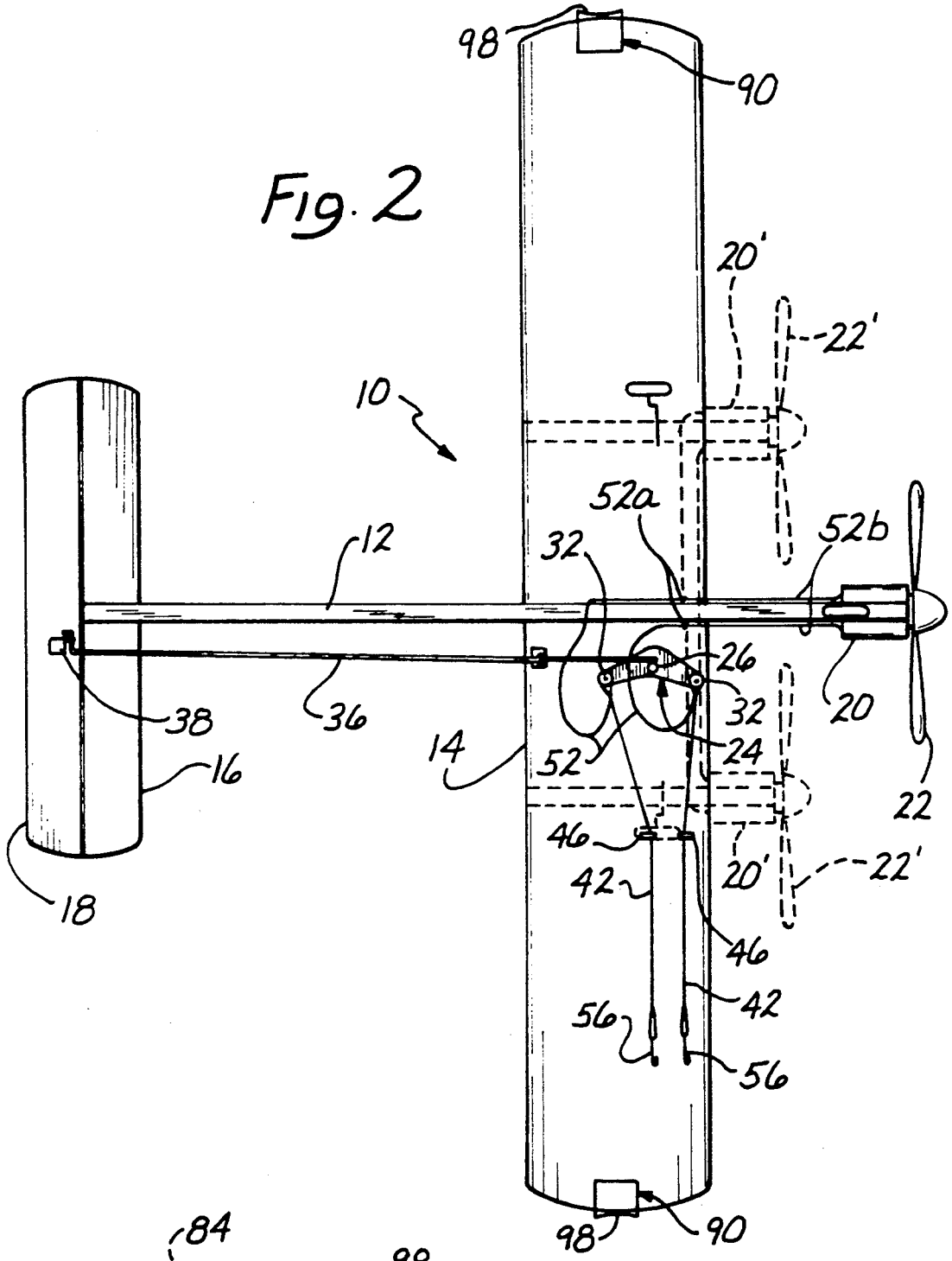
FIG. 2 is a bottom plan view of the aircraft of FIG. 1, showing a single engine model in solid lining and an alternate two engine model in dotted lining.

Turning to FIG. 2, a bottom plan view of the aircraft 10 of FIG. 1 is shown in solid lining. An alternative motor configuration for the aircraft 10 is suggested in dotted lining with motors 20' mounted one on each side of the fuselage on the wing 14, each driving a corresponding propeller 22' for providing greater thrust to an airframe suitably modified to take advantage of the same.

Figure 4:
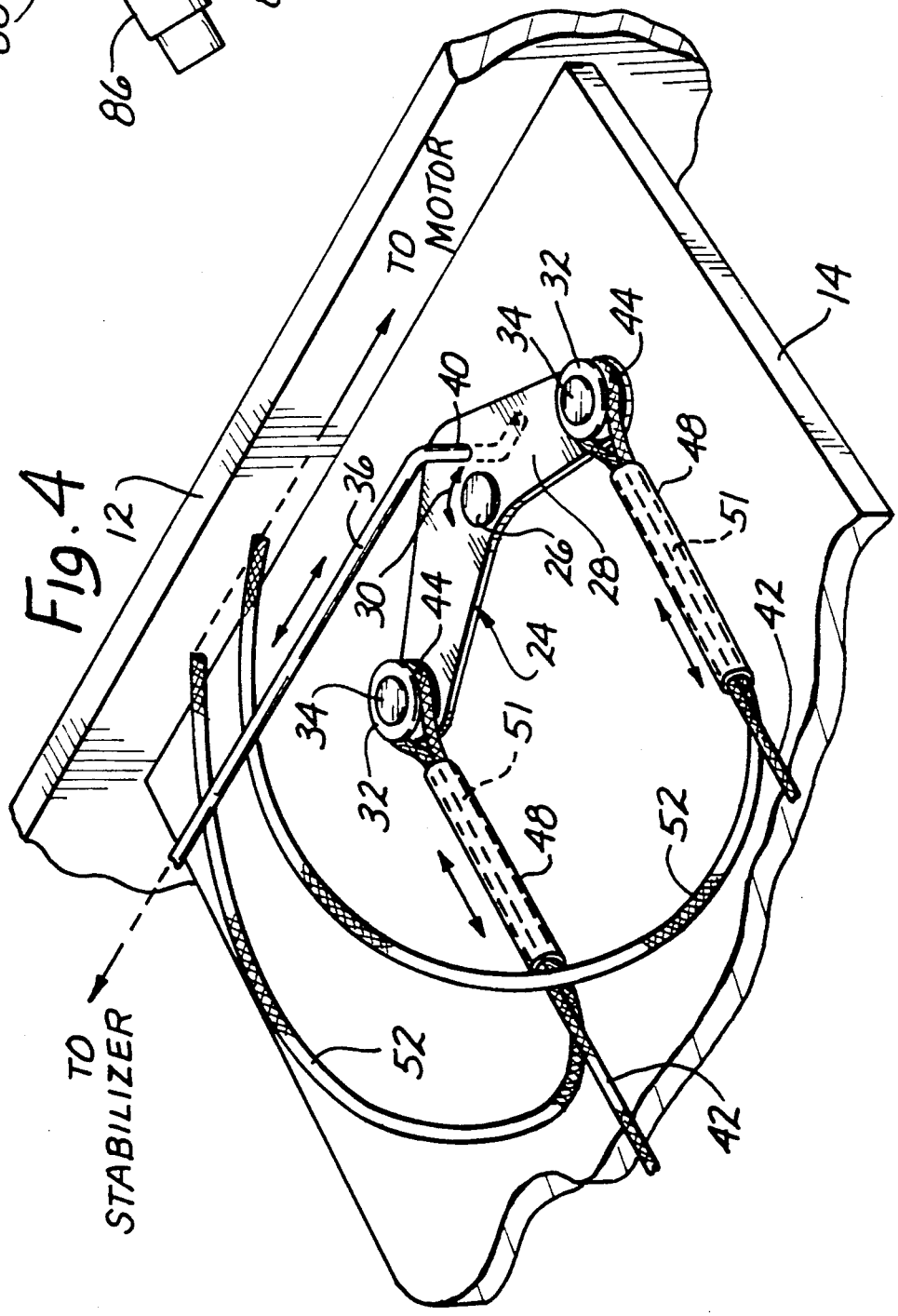
FIG. 4 is enlarged fragmentary perspective view of the underside of the aircraft wing showing the bell crank arrangement in the aircraft of FIGS. 1 and 2.

FIGS. 2 and 4 show the control line arrangement by which electrical power is supplied to the motor 20 or motors 20' and by which also the position of the elevator 18 is controlled by the ground operator. A bell crank 24 is pivoted at 26 to the underside of the wing 14. The bell crank which is best seen in FIG. 4 includes a long cross arm 28 and a transverse short arm 30. At each end of the cross arm 28 is mounted a roller 32 which can turn freely about an axle 34 fixed to the cross arm. A linkage rod 36 is connected at one end to the short arm 30 of the bellcrank and at its opposite end is hingedly connected at 38 to the underside of the elevator 18 as shown in FIG. 2. The linkage 36 is a length of thin but stiff wire which is bent at right angles at the bell crank end, with the end 40 of the linkage rod fitted into a hole formed in the short arm 30 so as to allow the wire end 40 to turn within the hole as the bell crank 24 turns about pivot 26, causing the linkage rod 36 to push or pull at the elevator connection 38 causing the elevator 18 to swing up or down respectively relative to the stabilizer plane 16.

A pair of control lines 42, which are relatively thin, flexible, lightweight, electrically insulated stranded conductive wires are each looped one turn 44 about a corresponding roller 32 on the bell crank as best seen in FIG. 4. The control cables, preferably 24 gauge, 19 strand insulated copper wire, each include a straight segment 42 which extends from the opposite ends of the bell crank 24 towards the outer tip of the wing 14 and are held in spaced apart relationship by wire guides 46 shown fixed to the underside of the wing 14 in FIG. 2. The control lines are each wound once about a corresponding roller 32 to each form a loop 44 which preferably slips loosely about the roller 32. The loops 44 are held closed about the rollers by a tie element 48 which may take the form of a length of heat-shrink plastic tubing of the type used for electrical insulation purposes, as seen FIG. 4. The tie sleeve 48 holds together the straight segment 42 and a return segment 51 to make the closed loop 44 between the straight segment 42 and a slack segment 52. The flexible wire returning from the loop 44 and passing through the tie segments 48 continues as a slack segment 52 curving in a large radius from the tie 48 towards a point 52*a* at which each of the slack segments 52 is attached by adhesive or other convenient means and supported to the fuselage 12, one of the wires preferably passing through a hole to the opposite side of the silhouette fuselage. The two wires run along segments 52*b* from these attachment points 52*a* to electric terminals on the rear of the motor 20.

The ground controller 15 applies differential pulling force to the line pair 84 which is connected to the line segments 42, pulling preferentially on one or the other end of the bellcrank crossarm 28 and causing the bell crank to turn in one direction or the other about the pivot 26. The pair of lines 42 remain generally parallel during movement of the crossarm but the loops 44 turn easily about the fixed axles 34 either by slipping over the rollers 32 in low friction contact with the same, or by causing the rollers to turn about the respective axles 34. The result is a low friction connection between the wires 42 and the ends of crossarm 28 which is capable of sustaining considerable centrifugal loading but which eliminates any flexing strain on the wires 42 at the connection point with the crossarm. Furthermore, the return segments 52 of the wire are slack between the ties 48 and their respective points of attachment 52*a* to the fuselage and, describe a relatively long segment of large radius curving from the ties 48 back towards the fuselage 12 for attachment thereto such as at points 52*a*. Consequently, any strain imposed on the slack segments 52 is distributed over a relatively long segment of wire, minimizing the strain per unit length of the wire which is thus able to move without failure in response to pivotal movement of the bellcrank 24. Preferably the control wires on the aircraft 10 are each a single unbroken length of wire for superior mechanical and electrical reliability, and minimum cost and effort in assembly.

Figure 3A:
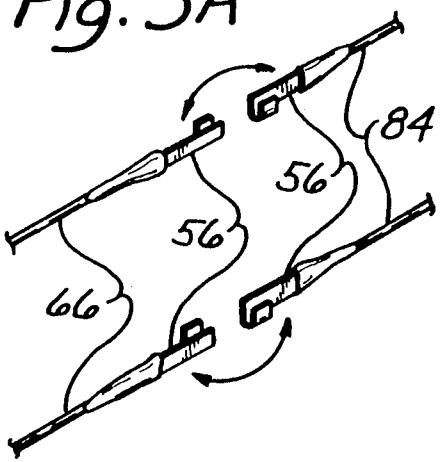
FIG. 3A shows in perspective two wire pairs terminated with knife disconnect type electric connectors prior to connection of the two wire pairs.
Figure 3B:
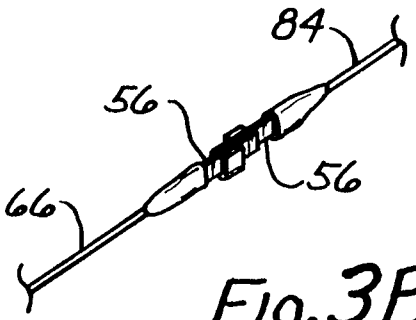
FIG. 3B shows in perspective two interconnected knife-disconnect type connectors mechanically and electrically coupling two wire segments.

The control line segments 42 are each provided at their free ends with a so-called "AMP knife disconnect" electrical connector 56, which are commercially available connectors commonly used in the aircraft industry. The knife disconnects 56, best illustrated in FIG. 3A, allow control line pairs 84 of different lengths, typically 15 to 30 feet for connecting the aircraft 10 to the handle 60 held by ground operator 15, to be conveniently interchanged to vary the radius of the flight pattern and to exchange control wires for any other reason. Such knife terminals 56, while widely used as electrical connectors in the full scale aircraft industry, have not previously found use in the application here described, and have been found to be particularly suited for interconnecting control line segments in captive flying model aircraft because of their easy and quick connectability while providing for a secure mechanical linkage along the axis of the control line, which coupled with their very low weight and small size makes these connectors highly useful for this purpose.

Figure 3:
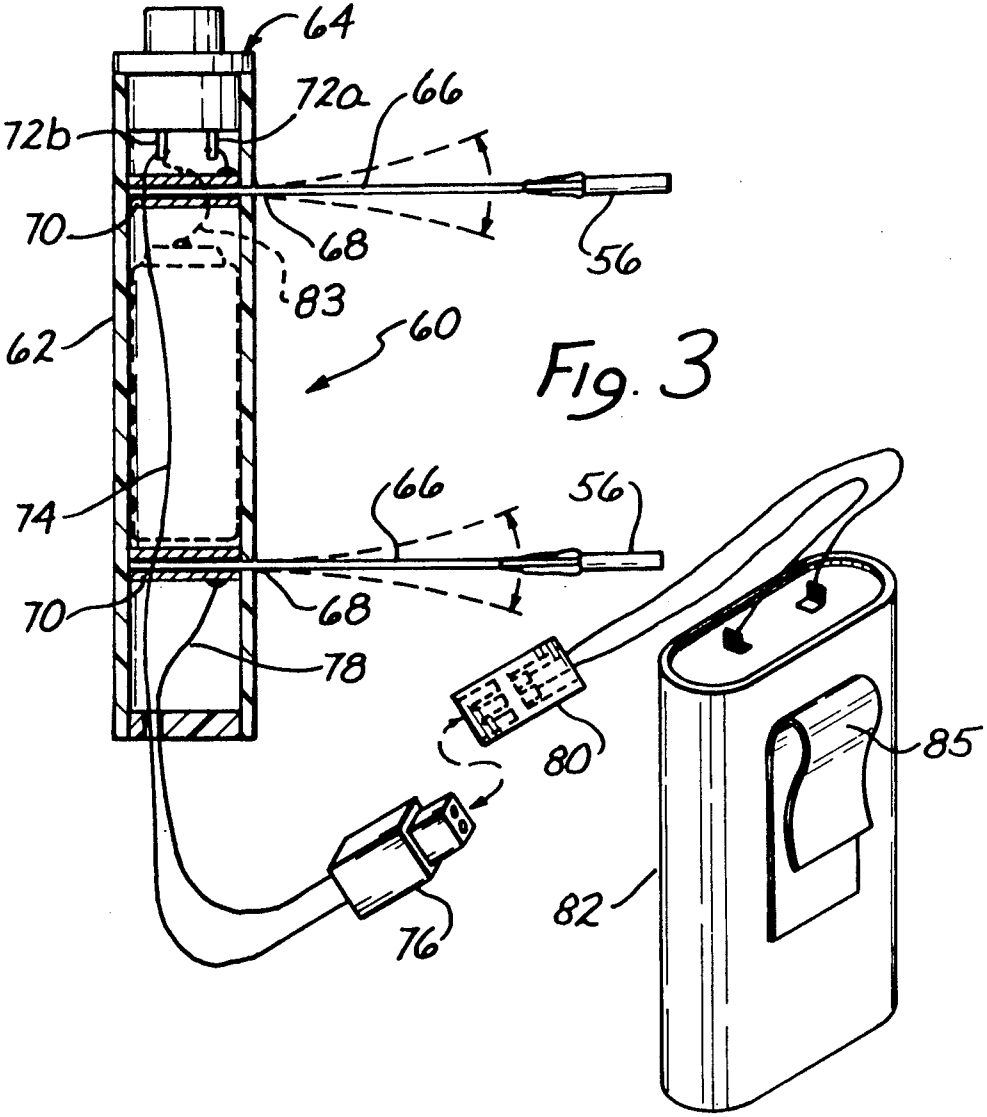
FIG. 3 is a longitudinal cross-section of the control handle, a typical rechargeable battery pack, and associated electrical connectors.

Turn now to FIG. 3 which shows in longitudinal cross section the control handle 60 held by the ground operator 15 for controlling the flight of the captive aircraft 10. The control handle includes a hollow housing 62 which may be a length of cylindrical tubing closed at an upper end by a single pole, single throw, normally open, push-button electric switch 64. Two relatively short lengths 66 of stranded steel cable, e.g. 14 or 16 gauge thickness and approximately 2-3 inches in length so that the cable segments 66 are readily flexible yet sufficiently stiff to extend away from the handle housing 62. The inner ends of the cable segments 66 pass through corresponding holes 68 in the wall of the housing 62 and into retaining bushings 70 which may be short lengths of copper tubing crimped onto the cable segments 66 to keep the cable segments from being pulled out of the handle housing 62. The upper bushing 70 is electrically connected to a first terminal 72*a* of the electrical switch 64, the other switch terminals 72*b* being connected by a length of conductor 74 to one prong of a female battery connector 76. The other prong of the battery connector 76 is connected by a second wire conductor 78 to the lower copper bushing 70 and hence to the lower cable segment 66. Each of the two cable segments 66 terminates in a knife disconnect 56 similar to those terminating the control line segments 42 on the aircraft 10.

Figure 6:
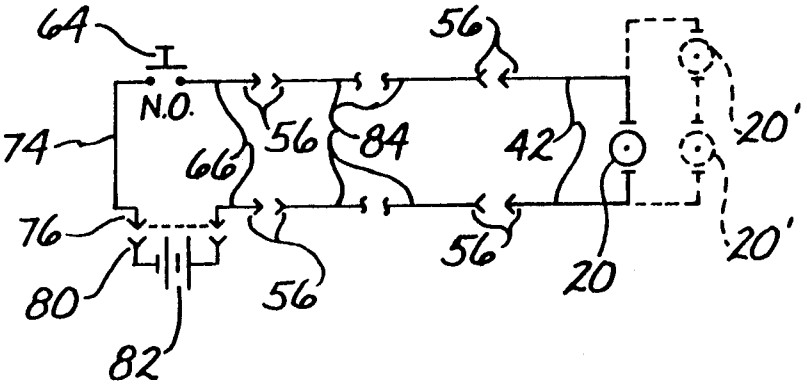
FIG. 6 shows a multiple battery adapter module for adapting the single battery control handle of FIG. 5 to a two battery (solid lined) or three battery (phantom lined) battery system.

The first battery connector 76 mates with a second battery connector 80 which is a standard female connector provided on commercially available six-cell rechargeable NiCad battery packs 82 of the type widely used among hobbyists for powering radio controlled toys, particularly remote controlled model cars and boats. For convenience, the battery pack may include a belt clip 85 by means of which the battery pack may be attached to the trouser belt of the ground operator, as shown in FIG. 1. Mating the battery connector 80 to the control handle connector 76 supplies the battery voltage to the steel cable segments 66 when normally open power control switch 64 is pressed closed by a ground operator 15. When the push button switch 64 is released however, electric power is interrupted to the cable segments 66. Each of the cable segments 66 is electrically and mechanically linked to a corresponding control segment 42 on the aircraft 10 by means of an intervening long control line 84 each of which also terminates at each end in a knife disconnect 56 engageable to a similar knife disconnect 56 on the control handle cables 66 and aircraft wires segments 42. FIG. 6 shows in schematic diagram form the electrical circuit of the entire toy aircraft system, including an alternative bi-motor aircraft arrangement shown in dotted lining wherein two electric motors 20' are connected in series in place of the single motor 20. One possible physical arrangement of the motors 20' and power supply wires in a bi-motor version of the aircraft 10 is suggested in dotted lining on FIG. 2, from which it is understood that the bellcrank arrangement remains unchanged as well as the slack wire segments 52 attached to the fuselage at points 52*a* from which points supply wires are run to the two motors 20' which in this example are connected in series with each other.

Figure 5:
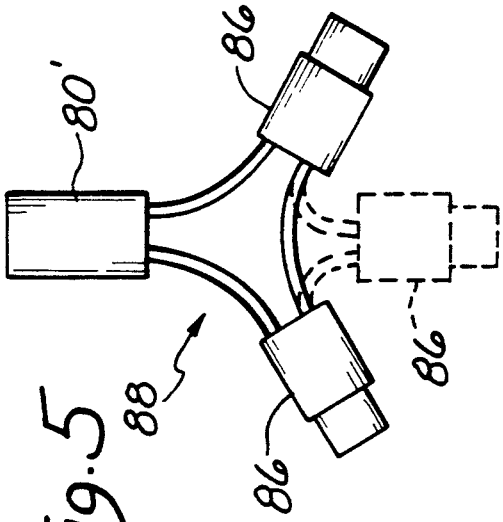
FIG. 5 is a schematic diagram of the electrical circuit of the model aircraft system with a two engine alternate system indicated in dotted lining.

FIG. 5 shows a multi-battery adapter module 88 used for connecting more than one battery such as battery 82 of FIG. 5 to the control handle connector 76. This may be desirable where a multi-engine aircraft is being flown or any other aircraft with higher power requirements. The adapter module of FIG. 3 has a plug 80' similar to plug 80 of battery 82 and mateable to the control handle plug 76. In the two-battery adapter shown in solid lining in FIG. 5 two connectors 86 of gender opposite to that of connector 80' and gender similar to that of the control handle connector 76 are connected in series with each other and with connector 80' by means of short lengths of wire to make-up a closed ring structure, such that when each of the third connectors 86 is mated to a corresponding connector 80 of a battery 82, the voltages of the two batteries 82 thus connected are summed at the output connector 80' and the summed voltage is supplied to the aircraft through the aforedescribed control line circuit. FIG. 5 also suggests in dotted lining the provision of a third connector 86 to make up a three-battery adapter module, the third connector 86 being likewise in series with the other connectors 86 and 80', for summing the voltages of three batteries 82 at the output connector 80'. FIG. 3 also suggests in dotted lining the possibility of including a rechargeable cell 82' within the handle housing 62 in electrical contact with the lower bushings 70 and connected to the switch 64 by dotted lead 83 for supplying power to the cable segments 66. In such an arrangement, the connector plug 76 may serve as a battery recharging plug and may be mounted to the lower end of the handle housing 62 as the external portions of battery connecting wires 74, 78 become unnecessary.

Figure 7:
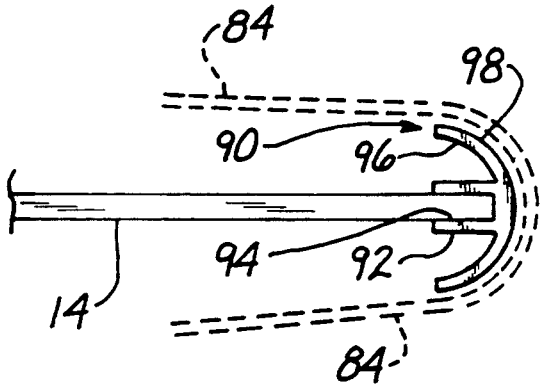
FIG. 7 is a front edge view of a wing-tip equipped with a removable wrap element and suggesting in phantom lining the wrapping of the long control lines on the same.

FIG. 7 shows the leading edge of a wing-tip of wing 14 of the aircraft of FIGS. 1 and 2, fitted with a dual purpose wrap element 90. The fitting 90 has a mounting portion 92 defining a slot 94 into which fits snugly the thickness of the wing-tip so as to frictionally retain the wrap element 90 on the wing 14. The fitting 90 further includes an outer portion 96 which defines an outer arcuate surface 98 preferably extending above and below the plane of wing 14, the outer surfaces 98 at the opposite wing-tips of the aircraft facing away from each other as shown in FIG. 2. These curved surfaces 98 provide a relatively large radiused surface, as compared to the thickness of the wing-tip, onto which the long control lines 84 may be wound, from wing-tip to wing-tip of wing 14, and over and under the fuselage 12 for convenient storage and protection of the lines against kinking and tangling. It is particularly important to prevent kinking of the wires 84 as these may then have a tendency to tangle during flight, unless kept relatively smooth and kink free during storage. The outer portion 96 of the fittings 90 also serves as a skid protecting the wing-tip against damaging scraping contact with the ground. The skid fittings 90 may be made of a variety of materials including plastic or as a metal clip, and may assume a variety of configurations adapted to the aforementioned purposes. It is desirable, however, for the fittings 90 to have a relatively low cross section in the direction of flight so as to minimize drag on the air frame. It is also desirable for the fittings 90 to be easily removable from the wing-tips when so desired.

While particular embodiments of the invention have been described and illustrated for purposes of example and clarity, it must be understood that many changes, substitutions and modifications to the described embodiments will become readily apparent to those possessed of ordinary knowledge in the art without departing from the scope and spirit of this invention which is defined by the following claims.

What is claimed is:

1. In a toy aircraft having one least one electric motor mounted to an airframe, an electrically conductive pair of wires including slack portions connected from said motor to opposite ends of the crossarm of a bellcrank pivotably mounted to the airframe linkage rod means connecting, said wires further including straight portions extending from said cross-arm for connection to a control handle for transmitting controlling force from a ground operator to said bellcrank and connected at the control handle to a power supply for powering said motor, the improvement comprising:

roller means at each end of the cross arm, each said conductive wire being tied into a loop between said straight and slack portions, said loop being rotatable on a corresponding roller relative to said cross-arm for transmitting mechanical force to said cross arm without flexing of the wires at said cross-arm ends to minimize the likelihood of breakage due to mechanical fatigue during flight of the aircraft.

2. The improvement of claim 1 wherein said wires are covered with insulating material and said rollers are of material selected to make low friction contact with said insulating material such that said loops are also easily slidable about said corresponding rollers.

3. The improvement of claim 1 wherein said straight portions of the wires terminate in knife-disconnect-type electrical connectors to allow interchangeable connection thereto of control wire pairs likewise terminating in knife disconnects.

4. The improvement of claim 1 wherein said handle includes two lengths of stranded steel cable insulated from each other and each fixed at one end to said handle and provided with a knife disconnect at an opposite free end for mechanical and electrical connection to one end of said control line pair, said steel cable withstanding repeated flexing as the handle leads or lags movement of the aircraft, and means for connecting said two lengths to a source of electrical power.

5. The improvement of claim 1 wherein said control handle includes a first connector mateable to the connector of a standard rechargeable battery pack.

6. The improvement of claim 5 further comprising a multi-battery adapter module comprising a second connector mateable to said first connector and a plurality of third connectors of gender opposite to said second connector and electrically in series with said second connector by means of short lengths of conductive wire to form a closed ring structure, whereby the voltages of batteries connected to each of said third connectors are summed at said second connector.

7. The improvement of claim 1 wherein said control handle is a hollow tube with two lengths of stranded steel cable extending transversely from said tube at axially spaced locations between two ends of the tube, each said length terminating in an electrical connector at a free end, an electric switch at one end of said tube, and an electrical connector attached to the opposite end of the tube for supplying power from an electrical source to said two lengths under control of said switch.

8. The improvement of claim 7 wherein said lengths are each held captive and in electrical contact at an inner end within a bushing of conductive material fixed transversely within said tube, said switch and said connector being each electrically connected to one of said bushings.

9. The improvement of claim 1 wherein said bellcrank is pivoted to one wing of said airframe and further comprising wireguide means fixed to said wing between said bellcrank and the tip of said one wing for spacing said wires from each other slidably through said wire guide means.

10. In a toy aircraft having at least one electric motor mounted to an airframe including a wing, a pair of slack conductive wires connected from said motor to opposite ends of the crossarm of a bellcrank pivotably mounted to the airframe linkage rod means connecting, said wires extending from said cross-arm to a control handle for transmitting controlling force from a ground operator to said bellcrank and connected at the control handle to a power supply for powering said motor, the improvement comprising:

a wrap element attached to each wingtip of said airframe for protecting said wingtip against contact with the ground during low level flight including take-off and landing, said wrap elements being configured and arranged for providing each a convex outer wire wrap surface, said wrap surfaces facing away from each other and characterized by a relatively large wrap radius substantially greater than the thickness of said wingtip in a plane transverse to the plane of said wing and connecting said wingtips to prevent kinking of the wires when said wires are wrapped from wing-tip to wing-tip over said wing for convenient carrying and storing.

11. A toy aircraft having two electric motors mounted to an airframe, each motor driving a propeller for applying thrust to said airframe, a pair of slack conductive wires connected from said motors to opposite ends of the crossarm of a bellcrank pivotably mounted to the airframe linkage rod means connecting, said wires extending from said cross-arm to a control handle for transmitting controlling force from a ground operator to said bellcrank and connected at the control handle to a power supply for powering said motors, said handle including a single electric switch connected for selectively supplying or interrupting power simultaneously to both said motors; and a roller at each end of said cross arm, each said conductive wire being tied in a loop slidable about a corresponding roller thereby avoiding flexing strain on said wires at said cross-arm.

12. In a toy aircraft having at least one electric motor mounted to an airframe, a pair of slack conductive wires connected from said motor to opposite ends of the crossarm of a bellcrank pivotably mounted to the airframe linkage rod means connecting, said wires extending from said cross-arm to a control handle for transmitting controlling force from a ground operator to said bellcrank and connected at the control handle to a power supply for powering said motor, the improvement comprising:

a roller at each end of the cross arm, each said conductive wire being tied into a loop, said loops being slidable about a corresponding one of said rollers relative to said cross-arm thereby avoiding fixed connections of said wires to said cross-arm susceptible to mechanical fatigue, said handle including two short lengths of stranded steel cable insulated from each other and each fixed at one end to said handle and provided with an electrical connector at an opposite free end for connection to a corresponding one of said two wires, said steel cable withstanding repeated flexing as the handle leads or lags movement of the aircraft, whereby flexing of said wires is substantially reduced at each end by said rollers and said steel cable and said wires are thus protected against breakage during flight of the aircraft.

13. The toy aircraft of claim 12 further comprising a skid element attached to each wingtip of said airframe for protecting said wingtip against contact with the ground during low level flight including take-off and landing, said skid elements being configured and arranged for providing a relatively large radiused wrap surface to prevent kinking of the wires when the wires are wrapped from wing-tip to wing-tip for convenience in carrying and storing the aircraft.

14. The toy aircraft of claim 12 further comprising a multi-battery adapter module comprising a second connector mateable to a first connector on said handle and a plurality of third connectors of gender opposite to said second connector and electrically in series with said second connector by means of short lengths of conductive wire to form a closed ring structure, whereby the voltages of batteries connected to each of said third connectors are summed at said second connector.

15. A modular toy aircraft system comprising:

a toy aircraft having at least one electric motor mounted to an airframe, a pair of continuous flexible insulated conductive wires electrically connected to said motor and terminating each in a knife-disconnect type electrical connector, each said wire being mechanically connected at an intermediate point thereof to one of two opposite ends of the crossarm of a bellcrank pivotably mounted to the airframe linkage rod means connecting, said wires having segments extending from said cross-arm;

a control handle for transmitting controlling force from a ground operator to said bellcrank, said handle including two short lengths of stranded steel cable insulated from each other and each fixed at one end to said handle and provided with a knife-disconnect-type electrical connector at an opposite free end for connection to a corresponding one of said two wires, said steel cable withstanding repeated flexing as the handle leads or lags movement of the aircraft;

battery means at the control handle for supplying electric power from a battery to said motor; and a pair of electrically conductive control lines, each line terminating at both its ends in a knife-disconnect-type electrical connector for operatively releasably interconnecting said control handle and said toy aircraft;

whereby all said releasable interconnections are spaced from both said bellcrank and said handle and substantially relieved of flexing motion during flight of said aircraft.

16. The modular system of claim 15 wherein said battery means comprises a battery contained within said handle, and connector means on said handle for connecting the battery to an electric power supply for recharging said battery.

17. The modular system of claim 15 wherein said battery means comprise a first battery connector mateable to the connector of a standard rechargeable battery.

18. The modular system of claim 17 further comprising one or more multi-battery adapter modules, each module comprising a second connector mateable to a first connector on said handle and a plurality of third connectors of gender opposite to said second connector and electrically in series with said second connector by means of short lengths of conductive wire to form a closed ring structure, whereby the voltages of batteries connected to each of said third connectors are summed at said second connector.

19. The modular system of claim 15 further comprising wrap element removably attachable to each wingtip of said airframe for substantially protecting said wingtip against contact with the ground during low level flight including take-off and landing, said wrap elements being configured and arranged for providing a relatively wrap surface having a radius substantially greater than the thickness of said wingtip to prevent kinking of the wires when the wires are wrapped from wing-tip to wing-tip of said airframe for convenience in carrying and storing the aircraft.

20. In a toy aircraft having at least one electric motor mounted to an airframe, a pair of slack conductive wires connected from said least one motors to opposite ends of the crossarm of a bellcrank pivotably mounted to the airframe, linkage rod means connecting said bell crank for actuating a control surface on said airframe, said wires extending from said cross-arm to a control handle for transmitting controlling force from a ground operator to said bell crank and connected at the control handle to an electrical power supply for supplying electrical current to said motor;

each said wire including a continuous segment; and means at each end of the crossarm rotatably securing an intermediate location of each said segment to said crossarm to minimize flexing and mechanical fatigue and breakage of said wires during flight of the aircraft, said means at each end being electrically insulated from said conductive wire, said means being rotatably mounted to said cross arm and each said wire being attached to a corresponding one of said means.

* * * * *